US012774121B2

(12) United States Patent
Krohn et al.

(10) Patent No.: US 12,774,121 B2
(45) Date of Patent: Oct. 27, 2026

(54) STRAPPING MACHINE HAVING COMPACT STRAP DISPENSERS

(71) Applicant: Signode Industrial Group LLC, Tampa, FL (US)

(72) Inventors: Christopher S. Krohn, Grayslake, IL (US); Joel Patel, Hawthorn Woods, IL (US); Douglas Felsecker, Saint Charles, IL (US); Nicole Ostryzniuk, St. John, IN (US); Joseph E. Lininger, Union Grove, WI (US)

(73) Assignee: Signode Industrial Group LLC, Tampa, FL (US)

( * ) Notice: Subject to any disclaimer, the term of this patent is extended or adjusted under 35 U.S.C. 154(b) by 221 days.

(21) Appl. No.: 18/291,744

(22) PCT Filed: Jul. 29, 2021

(86) PCT No.: PCT/US2021/043750
§ 371 (c)(1),
(2) Date: Jan. 24, 2024

(87) PCT Pub. No.: WO2023/009126
PCT Pub. Date: Feb. 2, 2023

(65) Prior Publication Data

US 2025/0091745 A1 Mar. 20, 2025

(51) Int. Cl.
*B65B 13/20* (2006.01)
*B65B 13/12* (2006.01)
(Continued)

(52) U.S. Cl.
CPC ..... *B65B 13/12* (2013.01); *B65B 13/18* (2013.01); *B65B 13/20* (2013.01); *B65B 13/24* (2013.01)

(58) Field of Classification Search
CPC ..... B65B 13/12; B65B 13/20; B65B 13/24; B65B 13/18; B65B 13/04; B65H 16/005;
(Continued)

(56) References Cited

U.S. PATENT DOCUMENTS 2,506,354 A 5/1950 Green
3,759,169 A 9/1973 Goodley
(Continued)

FOREIGN PATENT DOCUMENTS

JP 3216657 U * 6/2018 ..... B65B 67/00
KR 20160146101 A 12/2016

OTHER PUBLICATIONS

"EP0-3080 Strapping Dispenser", Encore Packaging, LLC, located at https://www.youtube.com/watch?v=scviU6881Ac&ab_channel=EncorePackaging%2CLLC, Mar. 26, 2013.
(Continued)

*Primary Examiner* — Jimmy T Nguyen
(74) *Attorney, Agent, or Firm* — Neal, Gerber & Eisenberg LLP

(57) ABSTRACT

Various embodiments of the present disclosure provide a strapping machine that includes a plurality of compact strap dispensers that collectively take up less space adjacent to the frame of the strapping machine and thus provide a strapping machine with an overall reduced footprint. In certain embodiments, the strap dispensers include a static dispenser frame and a coil carriage that supports a strap coil and that is movable relative to the dispenser frame between a strap-dispensing position and an extended position. In the strap-dispensing position, the strap dispenser can dispense strap from the strap coil. In the extended position, the strap coil is positioned clear of the dispenser frame and any adjacent dispensers to enable easy strap-coil replacement. In various embodiments, the strap dispensers include a quick-release
(Continued)

retainer that retains the strap coil in place on the coil carriage while being quickly and easily removable for coil changes.

15 Claims, 14 Drawing Sheets

(51) Int. Cl.
*B65B 13/18* (2006.01)
*B65B 13/24* (2006.01)

(58) Field of Classification Search
CPC .... B65H 16/04; B65H 16/021; B65H 16/023; B65H 49/32; B65H 49/36; B65H 2701/362; B65H 2701/375
See application file for complete search history.

(56) References Cited

U.S. PATENT DOCUMENTS

| | | | | |
|---|---|---|---|---|
| 3,952,961 | A | 4/1976 | Antepenko | |
| 3,963,191 | A | 6/1976 | Goodley | |
| 4,951,562 | A | 8/1990 | Ribaldo | |
| 5,284,247 | A | 2/1994 | Turner | |
| 5,285,981 | A * | 2/1994 | Pavelka | B65H 49/32 242/129 |
| 6,463,848 | B1 | 10/2002 | Haberstroh et al. | |
| 6,945,164 | B2 * | 9/2005 | Kobiella | B65B 13/18 100/26 |
| 7,331,543 | B2 | 2/2008 | Yu | |
| 7,377,213 | B1 | 5/2008 | Haberstroh et al. | |
| 9,630,803 | B2 | 4/2017 | Boss et al. | |
| 11,491,752 | B2 | 11/2022 | Termanas et al. | |
| 2004/0200191 | A1 | 10/2004 | Armstrong et al. | |
| 2006/0245890 | A1 | 11/2006 | Hartman et al. | |
| 2007/0120003 | A1 * | 5/2007 | Grant | B65H 49/32 242/139 |
| 2012/0012012 | A1 * | 1/2012 | Bruning | A01F 15/12 100/8 |
| 2020/0139657 | A1 | 5/2020 | Termanas et al. | |

OTHER PUBLICATIONS

"International Search Report and Written Opinion", from corresponding PCT/US2021/043750, Jul. 5, 2022.
First Office Action with English Translation, from corresponding Chinese Patent Application No. CN202180101067.2, Dec. 20, 2025.
Second Office Action and Search Report, from corresponding Chinese Patent Application No. CN202180101067.2, with English translation, Aug. 22, 2026.

* cited by examiner

STRAPPING MACHINE HAVING COMPACT STRAP DISPENSERS

PRIORITY

This application is a national phase application of and claims priority to and the benefit of PCT/US2021/043750, filed on Jul. 29, 2021, the entire contents of which is incorporated herein by reference.

FIELD

The present disclosure relates to strapping machines, and more particularly to strapping machines having compact strap dispensers that supply strapping for applying to loads.

BACKGROUND

A strapping machine forms a tensioned loop of plastic strap (such as polyester or polypropylene strap) or metal strap (such as steel strap) around a load. A typical strapping machine includes a support surface that supports the load, a strap chute that defines a strap path and circumscribes the support surface, a strapping head that forms the strap loop and is positioned in the strap path, a controller that controls the strapping head to strap the load, a frame that supports these components, and a strap supply.

To strap the load, the strapping head first feeds strap (leading strap end first) from the strap supply into and through the strap chute (along the strap path) until the leading strap end returns to the strapping head. While holding the leading strap end, the strapping head retracts the strap to pull the strap out of the strap chute and onto the load and tensions the strap to a designated strap tension. The strapping head then cuts the strap from the strap supply to form a trailing strap end and attaches the leading and trailing strap ends to one another, thereby forming a tensioned strap loop around the load. Certain strapping machines have multiple strapping heads and respective strap chutes that define respective strap paths. These strapping machines are configured to simultaneously form multiple tensioned strap loops around a load. The strap supplies of these strapping machines include multiple separate strap dispensers that each feed strap from separate strap coils to the respective strapping heads.

Press-type strapping machines are configured to apply a compressive force to the load to compact the load before strapping (such as to compact a stack of collapsed corrugated boxes before strapping) and/or to reduce the likelihood that the load will shift during strapping (such as to stabilize a stack of lumber during strapping). A typical press-type strapping machine includes a platen supported by the frame and vertically movable (under the control of the controller) relative to the support surface (and the load). Before strapping the load, the platen moves downward toward the support surface and into contact with the load, compressing the load if the load is compressible (e.g., a stack of collapsed corrugated boxes). The controller periodically determines and monitors the compressive force the platen applies to the load, and stops the platen once the applied compressive force reaches a designated compressive force. At this point, the controller holds the platen in place and controls the strapping head to strap the load as detailed above. The platen then moves upward to disengage the load and enable the load to be moved out of the strapping machine. If the load is compressible, as the platen moves upward and disengages the load, the load attempts to return to its original height by expanding upward. As this occurs, the strap loops stretch slightly under this expansion force but prevent full expansion such that the strapped load is shorter than it was before compression and strapping but taller than it was when compressed. Compressing the loads before strapping not only makes the loads more compact and easier to store and handle, but also ensures the straps tightly bind the load together.

One issue with known strapping machines that have strap supplies with multiple strap dispensers is that the strap dispensers must be spaced far enough apart to enable an operator to easily remove an empty strap coil from the strap dispenser and replace it with a full strap coil. This required spacing results in the strap dispensers taking up a substantial amount of floor space and extending substantially beyond (such as more than 50% beyond) the width of the frame of the strapping machine, as shown in FIG. 1. More specifically, in FIG. 1, the area on the left represents the footprint of the strapping machine frame of a prior art strapping machine, and the area on the right represents the footprint of the set of strap dispensers of the strap supply of the strapping machine. The width of the footprint of the strap dispensers (the top-to-bottom direction represents width from the perspective shown in FIG. 1) is more than 50% larger than the width of the footprint of the strapping machine frame. This is not ideal for factory owners since factory floor space is at a premium. Additionally, this required spacing usually results in certain of the strap dispensers being laterally offset relative to their respective strapping heads so there's enough room to change the strap coils on all of the strap dispensers. This results in the strap chutes that direct the strap from the strap dispensers to the strapping heads including several bends, which increases the likelihood of jams during operation.

SUMMARY

Various embodiments of the present disclosure provide a strapping machine that includes a plurality of compact strap dispensers that collectively take up less space adjacent to the frame of the strapping machine and thus provide a strapping machine with an overall reduced footprint. In certain embodiments, the strap dispensers include a dispenser frame and a coil carriage that supports a strap coil and that is movable relative to the dispenser frame between a strap-dispensing position and an extended position. In the strap-dispensing position, the strap dispenser can dispense strap from the strap coil. In the extended position, the strap coil is positioned clear of the dispenser frame and any adjacent dispensers to enable easy strap-coil replacement. In various embodiments, the strap dispensers include a quick-release retainer that retains the strap coil in place on the coil carriage while being quickly and easily removable for coil changes.

DETAILED DESCRIPTION

Figure 1:
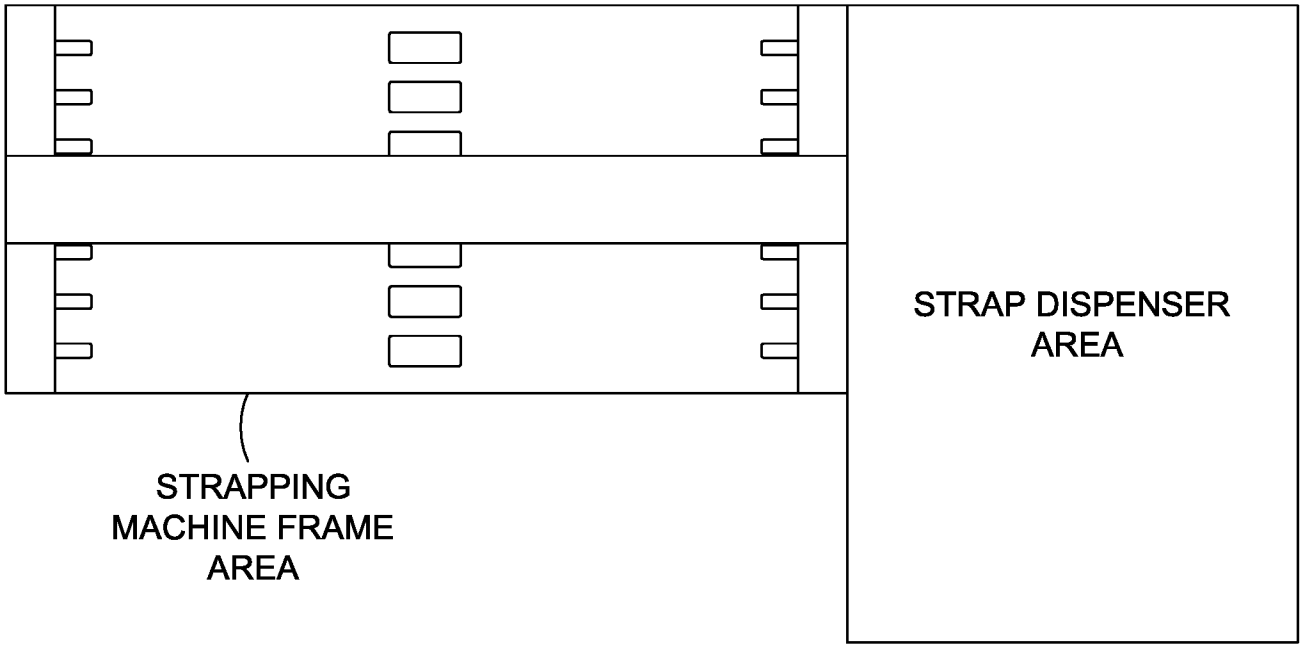
FIG. 1 PRIOR ART
FIG. 1 is a diagrammatic top view showing the footprints of the frame and the set of strap dispensers of a prior art strapping machine.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Various embodiments of the present disclosure provide a strapping machine that includes a plurality of compact strap dispensers that collectively take up less space adjacent to the frame of the strapping machine and thus provide a strapping machine with an overall reduced footprint. In certain embodiments, the strap dispensers include a static dispenser frame and a coil carriage that supports a strap coil and that is movable relative to the dispenser frame between a strap-dispensing position and an extended position. In the strap-dispensing position, the strap dispenser can dispense strap from the strap coil. In the extended position, the strap coil is positioned clear of the dispenser frame and any adjacent dispensers to enable easy strap-coil replacement. In various embodiments, the strap dispensers include a quick-release retainer that retains the strap coil in place on the coil carriage while being quickly and easily removable for coil changes.

Figure 2:
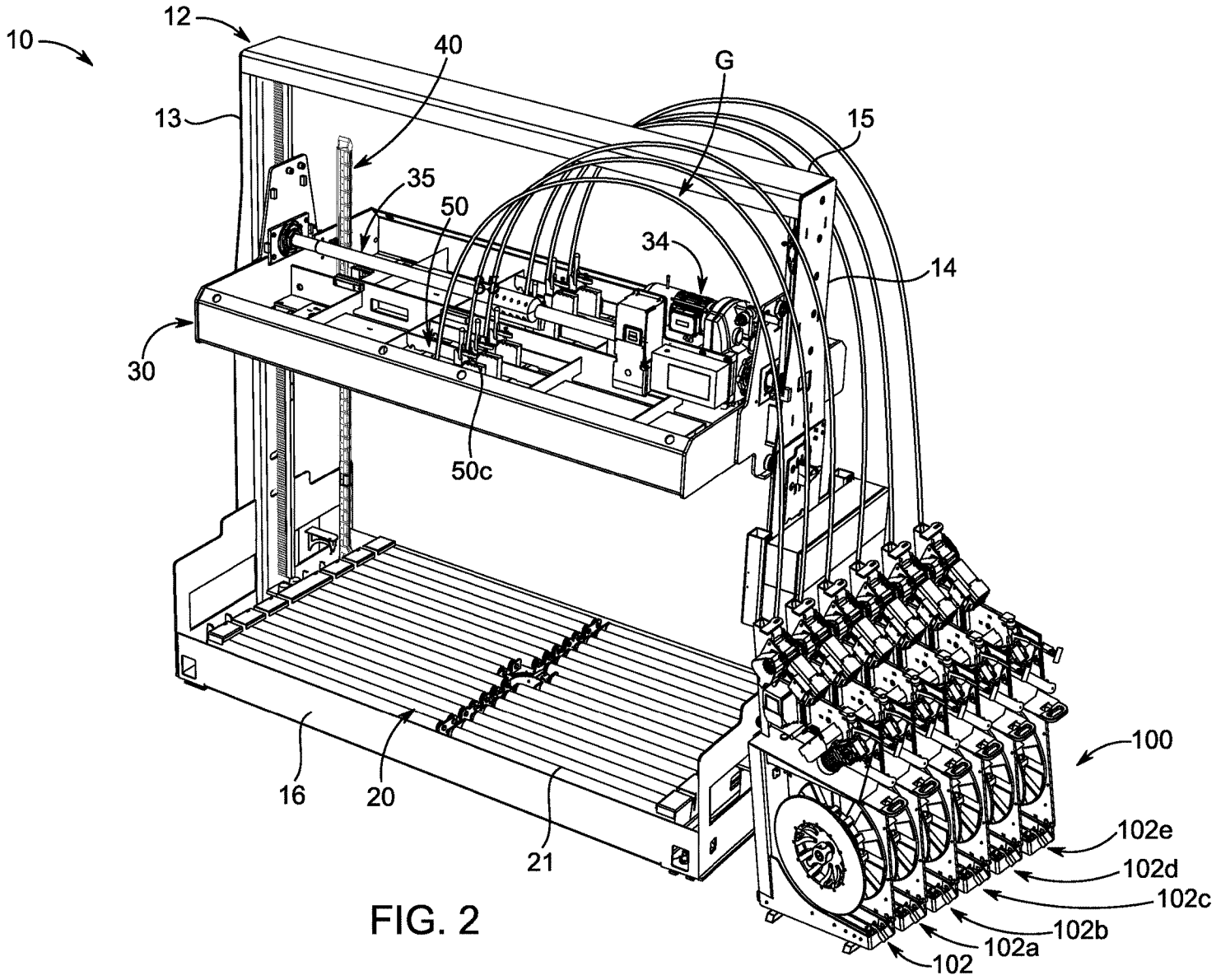
FIG. 2 is a perspective view of one example embodiment of a strapping machine of the present disclosure that includes a strap supply having a plurality of compact strap dispensers positioned adjacent to the machine frame of the strapping machine.
Figure 3:
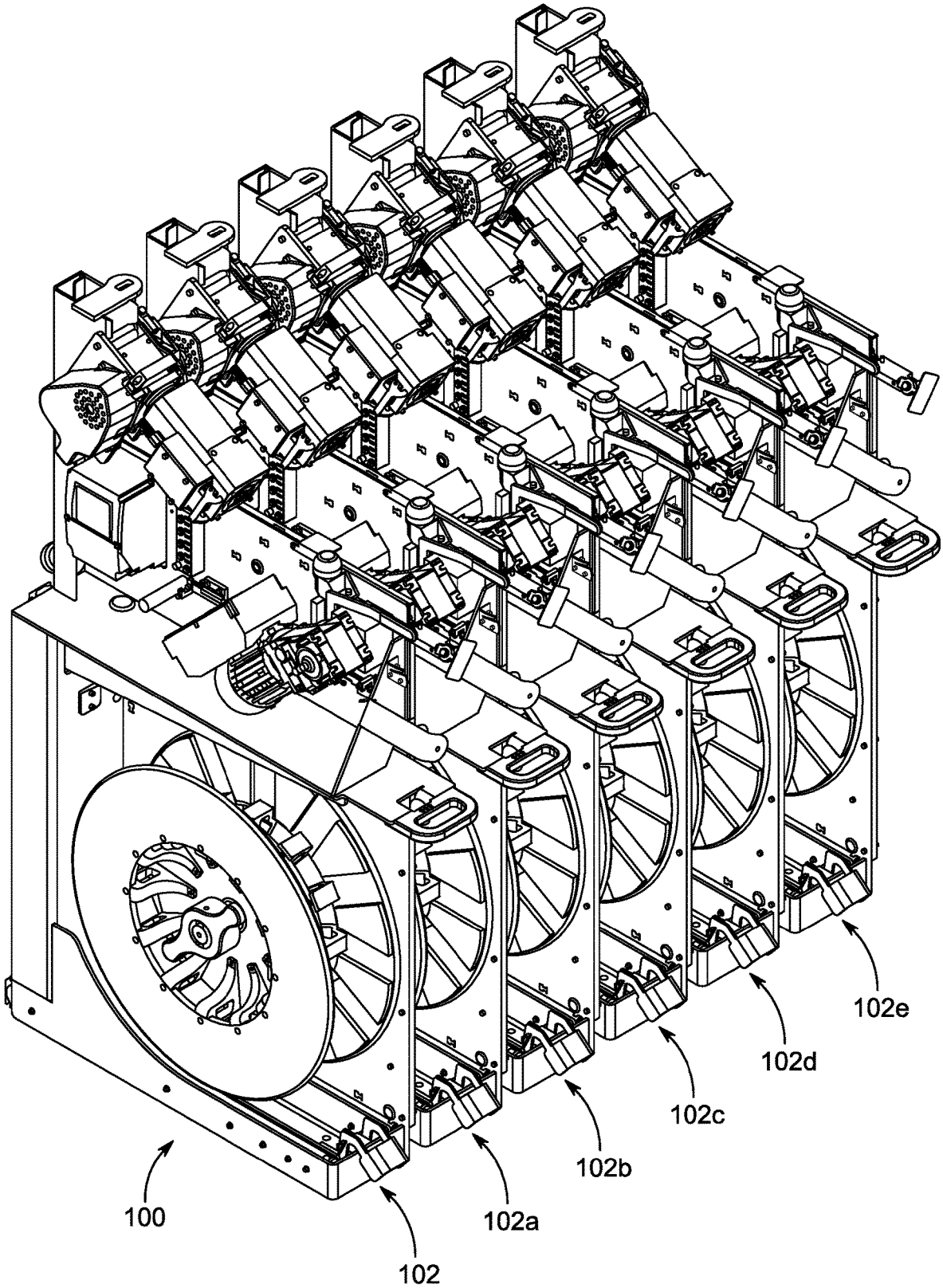
FIG. 3 is a perspective view of the strap dispensers of FIG. 2.

FIG. 2 shows one embodiment of an example press-type strapping machine 10 of the present disclosure (referred to as the "strapping machine" below for brevity) and components thereof. While a press-type strapping machine is used as an example herein, the present disclosure is not limited to press-type strapping machines and can be employed with any suitable strapping machine.

The strapping machine 10 includes a machine frame 12, a load supporter 20, a platen 30, a platen actuator 34, multiple strap chutes 40 (only one of which is shown and labeled for clarity), multiple strapping heads 50 (only one of which is labeled for clarity) each configured to draw strap from a strap supply 100, and a controller (not shown).

Figure 13:
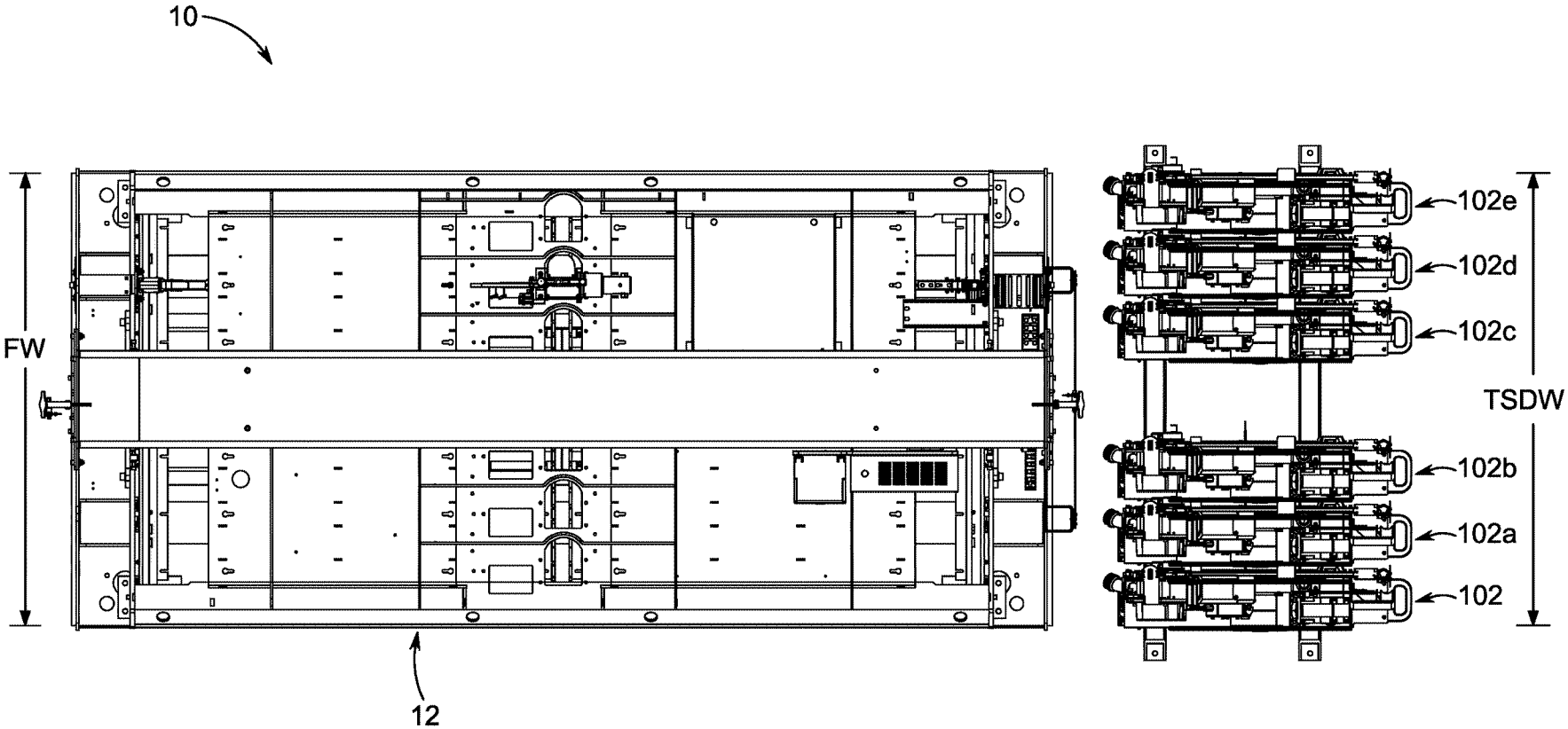
FIG. 13 is a top view of the strapping machine of FIG. 2 showing the relative positions of the machine frame of the strapping machine and the plurality of compact strap dispensers positioned adjacent to the machine frame and having a collective width less than or equal to the width of the machine frame.

The machine frame 12, which is best shown in FIGS. 2 and 13, is configured to support some of the other components of the strapping machine 10. In this example embodiment, the machine frame 12 includes a base 16, first and second spaced-apart upstanding legs 13 and 14 supported by the base 16, and a connector 15 that spans and connects the upper ends of the first and second legs 13 and 14. Although not shown in detail, the first and second legs 13 and 14 each include a vertically extending toothed rack to enable the platen 30 to move relative to the first and second legs 13 and 14 in a rack-and-pinion fashion. This is merely one example of a configuration of components that form the machine frame 12, and any other suitable configuration of any other suitable components may form the machine frame 12 in other embodiments.

The load supporter 20, which is best shown in FIG. 2, is configured to support and move loads through the strapping machine 10. The load supporter 20 includes a load-supporter frame (not labeled), a conveyor 21 mounted to the load-supporter frame, and a conveyor actuator (not shown). The conveyor 21 is configured to support loads during compression and strapping and to move loads through the strapping machine 10. In this example embodiment, the conveyor 21 includes multiple rollers (not labeled) driven by the conveyor actuator (such as via gearing, chains, belts, and the like). The conveyor actuator may be any suitable actuator, such as an electric, pneumatic, or hydraulic motor. The load supporter 20 is mounted to the base 16 of the machine frame 12 between the first and second legs 13 and 14 and below the connector 15.

The platen 30, which is best shown in FIG. 2, is configured to apply a compressive force to the loads to partially compress them before strapping. The platen 30 is supported by the first and second legs 13 and 14 above the load supporter 20 and is vertically movable relative to the load supporter 20 so the platen 30 can adjust to loads of different heights and apply a compressive force to the loads before and during strapping. In this example embodiment, the platen 30 includes two rotatable pinions (not shown) fixed to a pinion shaft 35 such that the pinions (not shown) and the pinion shaft 35 rotate together. The pinion shaft 35 spans the first and second legs 13 and 14 such that one pinion meshes with the toothed rack in the first leg 13 and the other pinion meshes with the toothed rack in the second leg 14. In this configuration, rotation of the pinions (which rotate together via their fixed connection to the pinion shaft 35) under control of the platen actuator 34 causes the pinions to climb or descend their respective toothed racks such that the platen 30 moves away from or toward the conveyor 21 of the load supporter 20 (i.e., upward or downward). The platen 30 also includes one or more compression surfaces (not shown) on its underside for contacting and applying the compressive force to the load.

The platen actuator 34 is any suitable actuator, such as an electric motor, operably connected to the platen 30 to move the platen 30 relative to the first and second legs 13 and 14 toward and away from the conveyor 21 of the load supporter 20 (i.e., downward and upward). In this example embodiment, the platen actuator 34 is operably connected to the pinions and the pinion shaft 35 of the platen 30 via gearing (not shown) such that rotation of an output shaft (not shown) of the platen actuator 34 results in rotation of the pinions (and the pinion shaft 35) and vertical movement of the platen 30. In one example embodiment, an output gear (not shown) of the gearing is meshed with one of the pinions such that rotation of the output gear (caused by rotation of the output shaft of the platen actuator 34) directly causes that pinon to rotate, which in turn causes the pinion shaft 35 and the other pinion to rotate. Rotating the output shaft of the platen actuator 34 in one direction results in movement of the platen 30 away from the conveyor 21, and rotation of the output shaft in the opposite direction results in movement of the platen 30 toward the conveyor 21. This is merely one example embodiment of the platen actuator, and any suitable actuator may be employed (such as a hydraulic or pneumatic actuator). Additionally, any other suitable manner of controlling vertical movement of the platen 30 may be employed (e.g., hydraulic or pneumatic cylinders, belt-and-pulley assemblies, and the like), as the rack-and-pinion configuration is merely one example embodiment.

Each strap chute 40 circumscribes the conveyor 21 and defines a strap path that the strap follows when fed through the strap chute 40 and from which the strap is removed when retracted. The strap chute 40 includes two spaced-apart first and second upstanding legs (only one of which is shown), an upper connecting portion (not shown) that spans the first and second legs and is positioned in the platen 30, a lower connecting portion (not shown) that spans the first and second legs and is positioned in the load supporter 20, and elbows that connect these portions. As is known in the art, the radially inward wall of the strap chute 40 is formed from multiple overlapping gates that are spring-biased to a closed position that enables the strap to traverse the strap path when fed through the strap chute 40. When the strapping head 50 later exerts a pulling force on the strap to retract the strap, the pulling force overcomes the biasing force of the springs and causes the gates to pivot to an open position, thereby releasing the strap from the strap chute so the strap contacts the load as the strapping head 50 continues to retract the strap.

Figure 4:
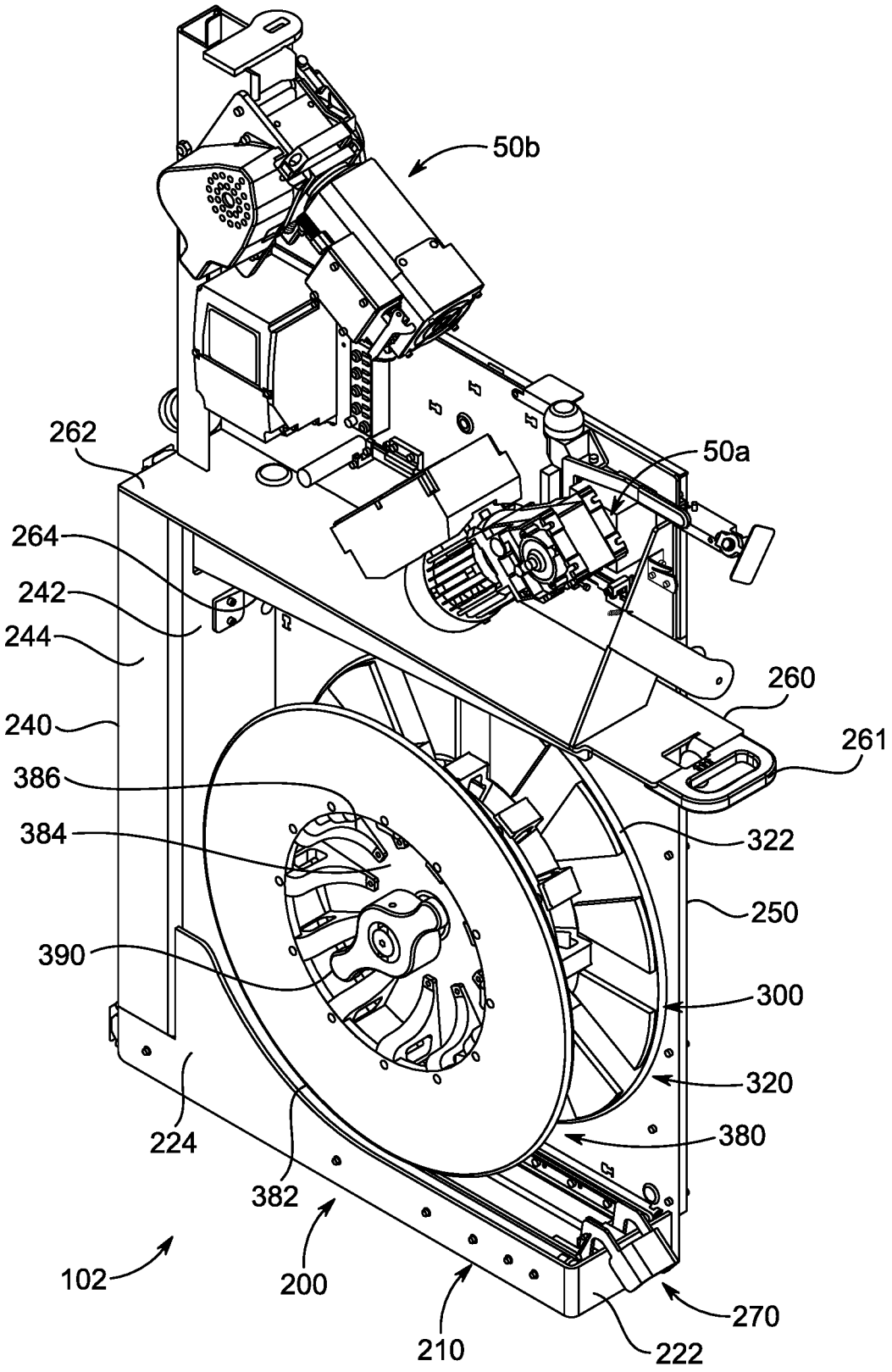
FIG. 4 is a perspective view of one of the strap dispensers of FIG. 2 with the coil carriage in the strap-dispensing position.
Figure 5:
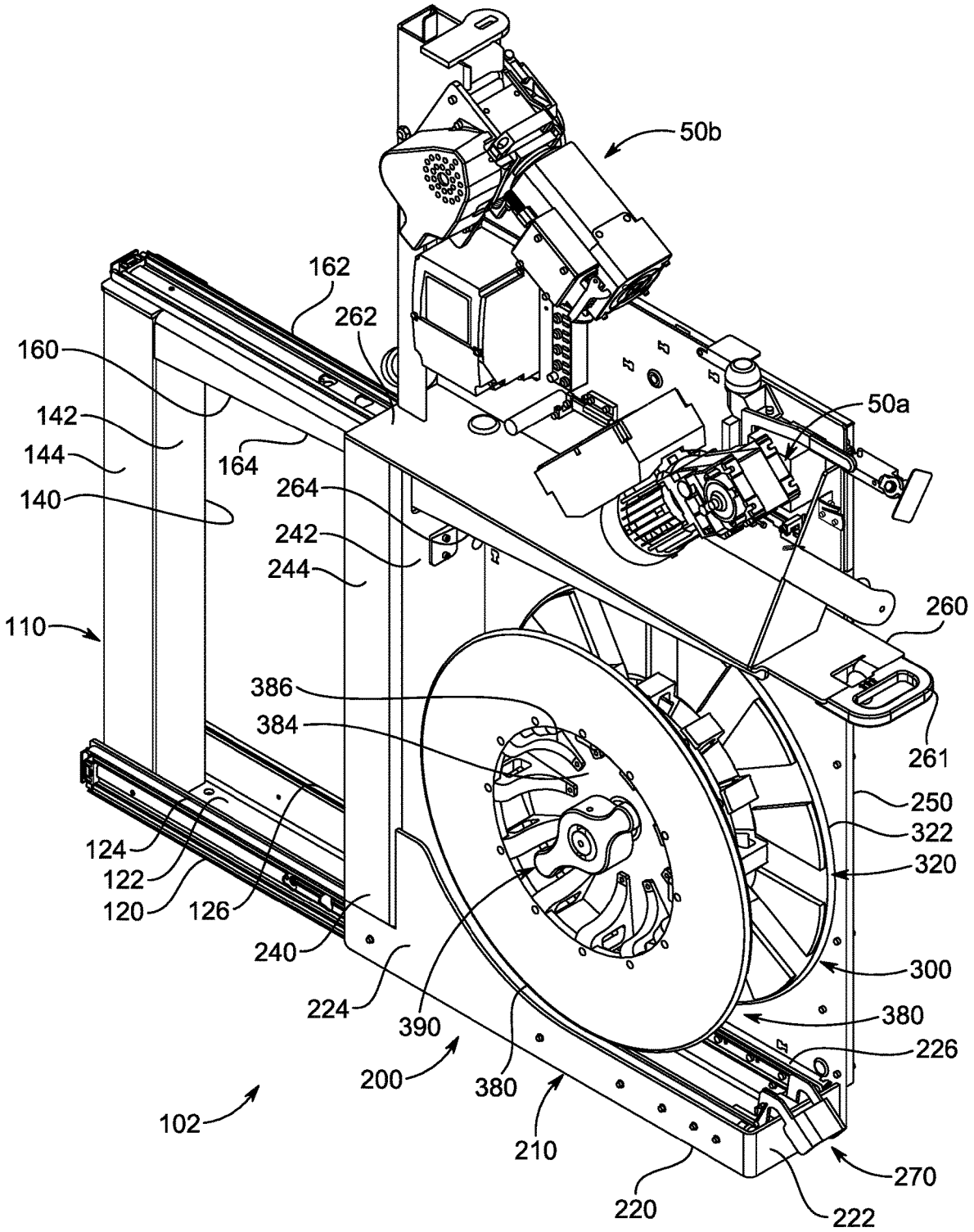
FIG. 5 is a perspective view of the strap dispenser of FIG. 4 with the coil carriage in the extended position.

The strapping head 50 is configured to form a tensioned strap loop around the load by feeding the strap through the strap chute 40 along the strap path, holding the leading strap end while retracting the strap to remove it from the strap chute 40 so it contacts the load, tensioning the strap around the load to a designated tension, cutting the strap from the strap supply to form a trailing strap end, and connecting the leading strap end and trailing strap end to one another. In this example embodiment, the strapping head 50 is a modular strapping head including a feed module 50*a*, a tensioning module 50*b*, and a sealing module 50*c*. As best shown in FIGS. 2, 4, and 5, the feed module 50*a*, which is configured to feed and retract the strap, and the tension module 50*b*, which is configured to tension the strap, are mounted to the respective strap dispenser of the strap supply 100 that feeds strap to the strapping head 50 (as described below). That is, in this example embodiment, the feed and tension modules 50*a* and 50*b* are located remote from the machine frame 12 of the strapping machine 10 (though in other embodiments the feed and/or tension modules may be supported by the machine frame 12 or any other suitable component of the strapping machine 10). The feed and tension modules 50*a* and 50*b* are independently removable and replaceable. The sealing module 50*c* is configured to hold the leading strap end, cut the strap from the strap supply, and connect the leading strap end and trailing strap end to one another. The sealing module 50*c* is removably mounted to the platen 30. A U-shaped strap guide G extends between the tensioning and sealing modules 50*b* and 50*c* and is configured to guide the strap as it moves between the modules.

In other embodiments, the strapping head 50 is any suitable non-modular strapping head (i.e., a strapping head that is not comprised of independently removable and replaceable feed and sealing modules). The manner of attaching the leading and trailing strap ends to one another depends on the type of strapping machine and the type of strap. Certain strapping machines configured for plastic strap include strapping heads with friction welders, heated blades, or ultrasonic welders configured to attach the leading and trailing strap ends to one another. Some strapping machines configured for plastic strap or metal strap include strapping heads with jaws that mechanically deform (referred to as "crimping" in the industry) or cut notches into (referred to as "notching" in the industry) a seal element positioned around the leading and trailing strap ends to attach them to one another. Other strapping machines configured for metal strap include strapping heads with punches and dies configured to form a set of mechanically interlocking cuts in the leading and trailing strap ends to attach them to one another (referred to in the strapping industry as a "sealless" attachment). Still other strapping machines configured for metal strap include strapping heads with spot, inert-gas, or other welders configured to weld the leading and trailing strap ends to one another.

The controller includes a processing device (or devices) communicatively connected to a memory device (or devices). For instance, the controller may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping machine 10 (such as to carry out the load verification and strapping process, as described below). The controller is communicatively and operably connected to the platen actuator 34, the conveyor actuator, and the strapping head 50 to receive signals from and to control those components.

The strap supply 100 of the strapping machine 10 includes a plurality of adjacently positioned compact strap dispensers 102, 102*a*, 102*b*, 102*c*, 102*d*, and 102*e*. The compact strap dispensers 102, 102*a*, 102*b*, 102*c*, 102*d*, and 102*e* are smaller and more compact than various known strap dispensers, are positionable adjacent to (and touching in certain configurations) each other, take up a smaller amount of floor space (adjacent to the rest of the strapping machine 10) than various known strap dispensers, are easier to maintain than various known strap dispensers and are easier to load and unload with strap coils than various known strap dispensers.

In this illustrated example, the compact strap dispensers 102, 102*a*, 102*b*, 102*c*, 102*d*, and 102*e* are identical, and for brevity only strap dispenser 102 is described below in detail. In other embodiments one or more of the strap dispensers are different. While this illustrated example includes six strap dispensers, the quantity of strap dispensers employed for any particular strapping machine may vary in accordance with the present disclosure.

FIGS. 4-12 show strap dispenser 102 in more detail. Strap dispenser 102 includes a dispenser frame 110 (best shown in FIGS. 5, 6, and 7) and a movable coil carriage 200 (best shown in FIGS. 4, 5, 6, 7, and 9) movably mounted to the dispenser frame 110 and moveable (here, slidable) between a strap-dispensing position (shown in FIGS. 2, 3, 4, 6, and 7) and a extended position (shown in FIG. 5). In the strap-dispensing position, the coil carriage 200 is positioned, oriented, and otherwise configured to enable the feed module 50*a* to pull strap from a strap coil (not shown) mounted on the coil carriage 200. In the extended position, the coil carriage 200 is positioned, oriented, and otherwise configured to enable an operator to remove an empty strap coil from the coil carriage 200 and replace it with a new strap coil, as further described below. In certain embodiments, the strap dispenser includes a coil-carriage biasing element (such as a spring) biasing the coil carriage to the strap-dispensing position.

The dispenser frame 110 is generally C-shaped in this example embodiment and includes a horizontally extending foot 120, a vertically extending leg 140 fixedly connected to the foot 120, and a horizontally extending arm 160 fixedly connected to the leg 140.

The foot 120 includes a bottom wall 122, an upright first side track wall 124 fixedly connected to the bottom wall 122, and an upright second side track wall 126 fixedly connected to the bottom wall 122 and spaced apart from and generally parallel to the first side wall 124. The bottom wall 122 is configured to be attached to a support (such as to a floor of a facility in which the strapping machine 10 operates or to an intermediate support that itself is attached to the floor). The first side track wall 124 and the second side track wall 126 respectively provide outwardly facing track components (not labeled) that are engaged by the coil carriage 200 to enable the coil carriage 200 to slidably move on the dispenser frame 110, as further discussed below. These track components can include any suitable tracks or track components such as but not limited to drawer slide tracks or other roller or wheel type track components that enable one member to slide relative to another member.

The leg 140 includes a plurality of suitably connected upright members (including members 142 and 144) that are suitably connected at their bottom end sections to the foot 120 of the dispenser frame 110.

The arm 160 includes a support track member 162 and a support track member brace 164 below and connected to the support track member 162. The support track member 162 and the support track member brace 164 are suitably connected to the upper end sections of the upright members of the upright leg 140. The base 120 and the upright leg 140 thereby support the arm 160 in a cantilevered manner. The support track member 162 provides upwardly facing track components (not labeled) for the coil carriage 200 to engage and slidably move on, as further discussed below. These track components can include any suitable tracks or track components such as but not limited to drawer slide tracks or other roller or wheel type track components that enable one member to slide relative to another member.

The coil carriage 200 includes a carriage frame 210 movably (and in this example embodiment slidably) connected to the dispenser frame 110, a strap-coil holder 300 supported by and rotatably connected to the carriage frame 210, the feed module 50*a* supported by and mounted to the carriage frame 210, and the tensioning module 50*b* supported by and mounted to the carriage frame 210.

The carriage frame 210 includes a horizontally extending base 220, a vertically extending upright member 240, a horizontally extending top member 260, a vertically extending support wall 250, and a coil-carriage locking assembly 270.

The base 220 includes an upright end wall 222, an upright first side track wall 224 fixedly connected to the end wall 222, and an upright second side track wall 226 fixedly connected to the end wall 222 and spaced apart from the first side track wall 224. The end wall 222 is configured to support the coil-carriage locking assembly 270 as described below. The first side track wall 224 and the second side track wall 226 are respectively slidably coupled with the first side track wall 124 and the second side track wall 126 of the foot 120 of the dispenser frame 110. This enables the base 220 to slidably move on the foot 120 of the dispenser frame 110 and partly enables the coil carriage 200 to slidably move on the dispenser frame 110. These walls can include any suitable track components in accordance with the present disclosure, such as but not limited to drawer slide tracks or other roller or wheel type track components that enable one member to slide relative to another member.

The upright member 240 includes a plurality of suitably connected upright members (including members 242 and 244) that are suitably connected at their bottom end sections to the base 220. The upright member 240 defines an internal first pocket (not shown or labeled) configured to receive the upright leg 140 of the dispenser frame 110 when the coil carriage 200 is in the strap-dispensing position (such as shown in FIG. 4).

The top member 260 includes a suitable handle (here handle 261), a support track member 262, and a support track member brace 264 below and connected to the support track member 262. The support track member 262 and the support track member brace 264 are suitably connected to the upper end sections of the upright members of the upright leg 240. The support track member 262 provides an internal downwardly facing track (not shown or labeled) for the coil carriage 200 to couple with and slidably move on the upwardly facing track of the support track member 162. This enables the top member 260 to slidably move on the arm 160 of the dispenser frame 110 and partly enables the coil carriage 200 to slidably move on the dispenser frame 110. This member can include any suitable track components in accordance with the present disclosure, such as but not limited to drawer slide tracks or other roller or wheel type track components that enable one member to slide relative to another member.

The top member 260 also defines an internal second pocket (not shown or labeled) configured to receive the arm 160 of the dispenser frame 110 when the coil carriage 200 is in the strap-dispensing position. The top member 260 is also configured to support the feed module 50*a* and the tensioning module 50*b*.

The support wall 250 is suitably connected to the base 220, the upright member 240, and the top member 260. The support wall 250 is configured to support the strap-coil holder 300, as further described below.

The strap dispenser 102 includes one or more engageable members and a coil-carriage locking assembly that cooperate to releasably lock the coil carriage 200 in the strap-dispensing position relative to the dispenser frame 110. Generally, the coil-carriage locking assembly is configured to releasably engage the one or more engageable members when the coil carriage 200 is in the strap-dispensing position and is actuatable to disengage the one or more engageable members to enable the coil carriage 200 to be moved to the extended position. In this illustrated example embodiment, which is further described below, the dispenser frame 110 includes the one or more engageable members and the coil carriage 200 includes the coil-carriage locking assembly. In other embodiments the coil carriage includes the one or more engageable members and the dispenser frame includes the coil-carriage locking assembly. In further embodiments, the dispenser frame includes certain components of the coil-carriage locking assembly, and the coil carriage includes other components of the coil-carriage locking assembly.

Figure 6:
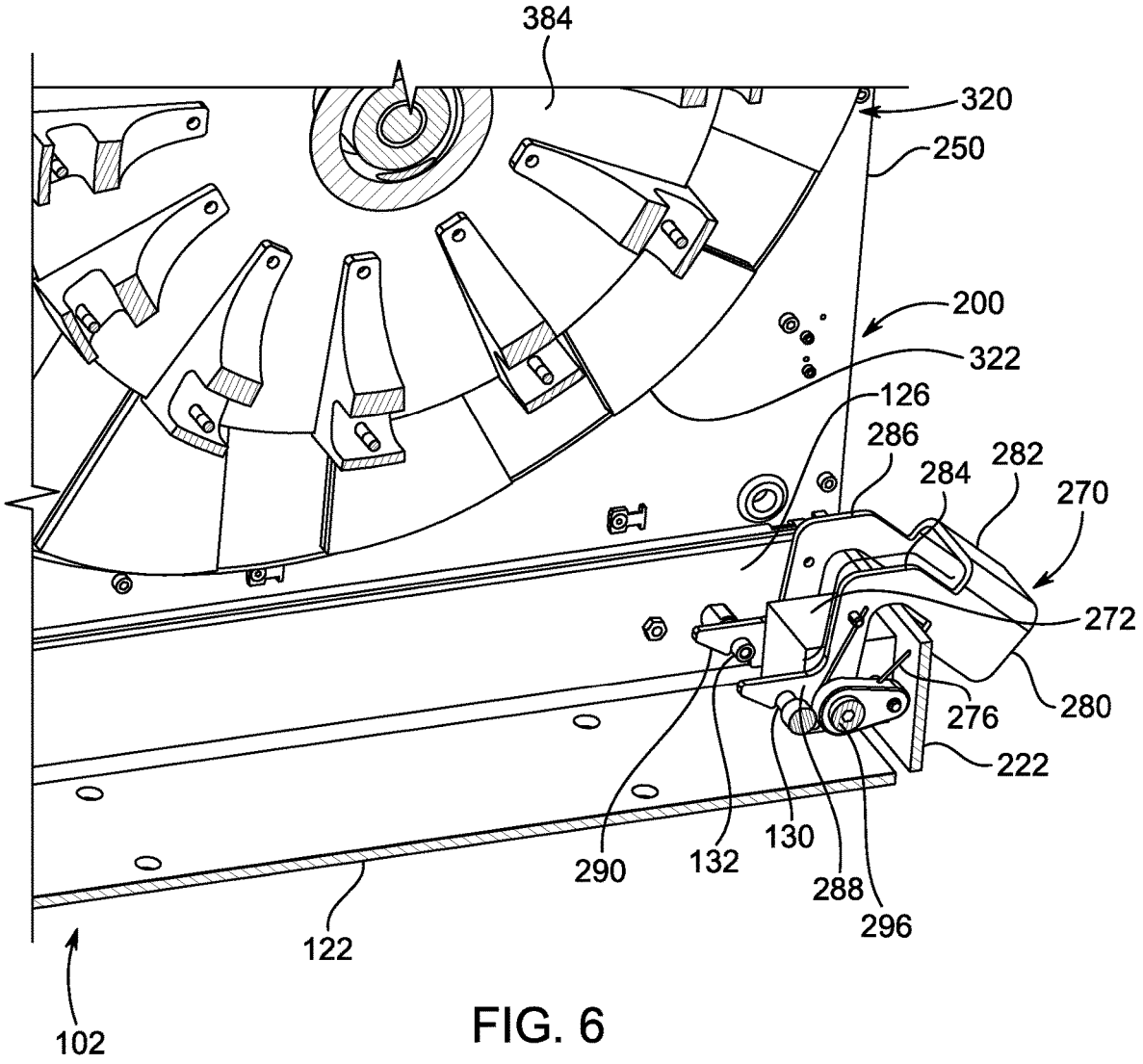
FIG. 6 is a cross-sectional perspective view of part of the coil carriage and the coil-carriage locking assembly of the strap dispenser of FIG. 4 with certain parts removed for clarity to show the coil-carriage locking assembly in the locked position.
Figure 7:
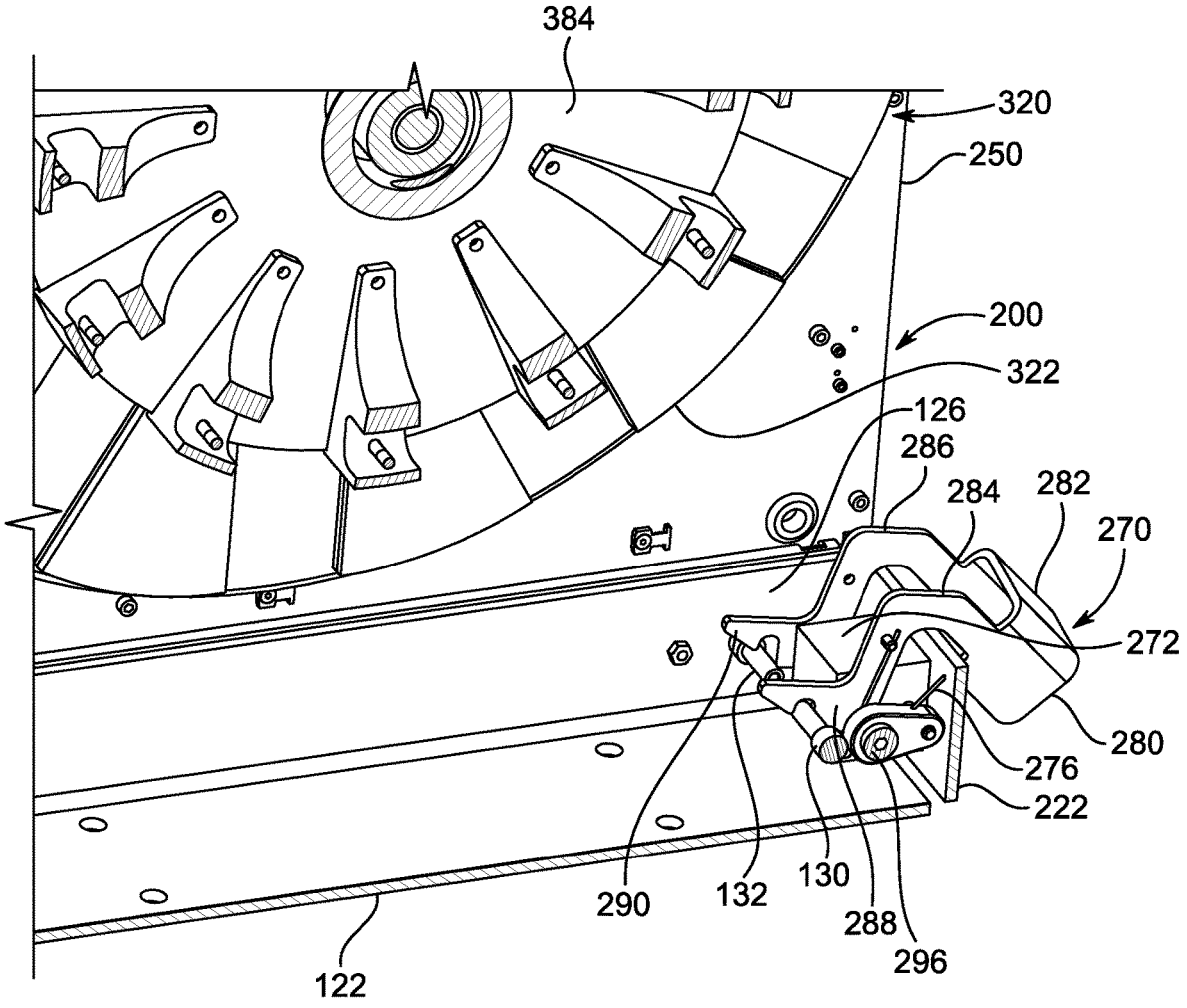
FIG. 7 is a cross-sectional perspective view of part of the coil carriage and the coil-carriage locking assembly of the strap dispenser of FIG. 4 with certain parts removed for clarity to show the coil-carriage locking assembly in the unlocked position.
Figure 8:
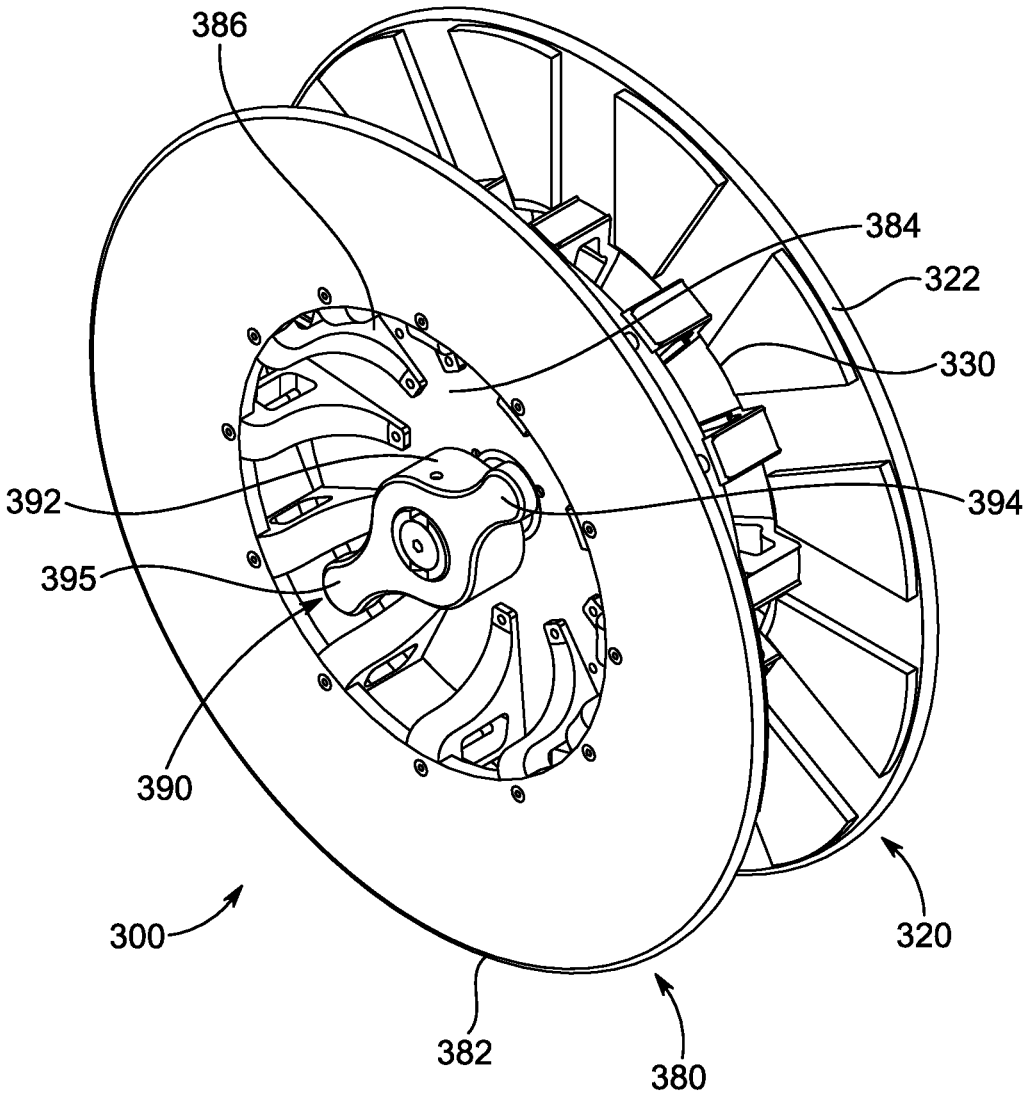
FIG. 8 is a perspective view of the strap-coil holder of the strap dispenser of FIG. 4.
Figure 9:
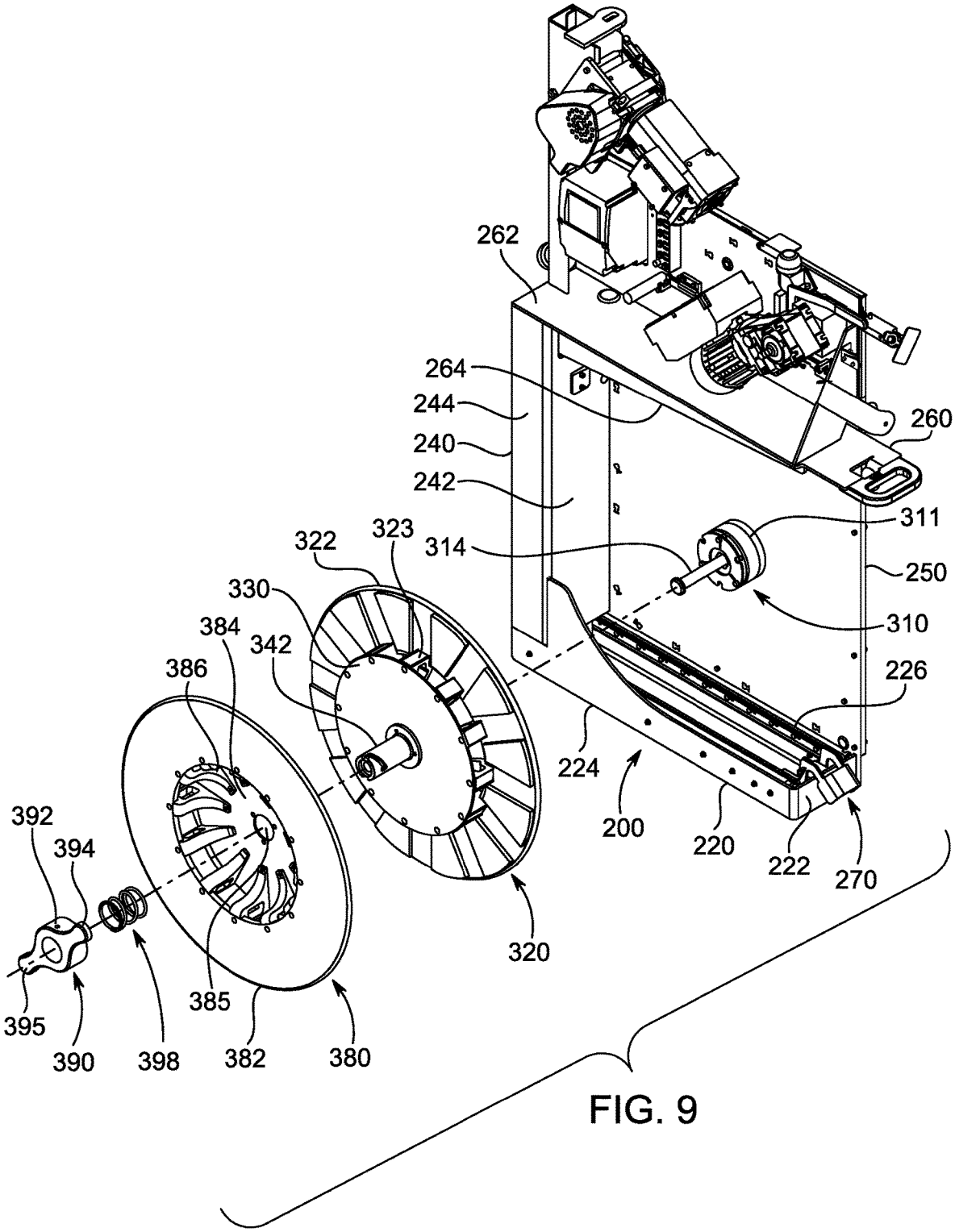
FIG. 9 is a partially exploded perspective view of the coil carriage and strap-coil holder of the strap dispenser of FIG. 4.

Turning to the one or more engageable members, the one or more engageable members may be any suitable components that are sized, shaped, positioned, oriented, and otherwise configured to be releasably engaged by the coil-carriage locking assembly. In this example embodiment, as best shown in FIGS. 6 and 7, the foot 120 of the dispenser frame 110 supports two engageable members in the form of a first locking pin 130 connected to and extending inwardly from the first side track wall 124 and a second locking pin 132 connected to and extending inwardly from the second side track wall 126. The first locking pin 130 and the second locking pin 132 are aligned and extend toward each other and are sized, shaped, positioned, oriented, and otherwise configured to be engaged by the coil-carriage locking assembly 270 (best shown in FIG. 6) of the coil carriage 200 to lock the coil carriage 200 to the dispenser frame 110 when the coil carriage 200 is in the strap-dispensing position.

Turning to the coil-carriage locking assembly, the coil-carriage locking assembly may be any suitable mechanism configured to releasably engage the one or more engagement members. Generally, the coil-carriage locking assembly includes one or more locking members movable between locked and unlocked positions, a locking-member biasing element biasing the one or more locking members to their locked positions, and a locking-member actuator operably connected to the one or more locking members and configured to move the one or more locking members from their locked positions to their unlocked positions. In the example embodiment, as best shown in FIGS. 6 and 7, the coil carriage 200 supports a coil-carriage locking assembly 270 including a locking-assembly support 272, a first biasing element 276, a second biasing element (not shown), and a locking member/actuator 280 pivotably mounted to the locking-assembly support 272 by a pivot pin 296.

The locking-assembly support 272 is connected to the end wall 222 of the base 220 of the carriage frame 210 of the coil carriage 200 and extends inwardly therefrom. The locking-assembly support 272 defines a transverse bore through which the pivot pin 296 extends. The locking-assembly support 272 supports the locking member/actuator 280, the first biasing element 276, and the second biasing assembly, which are all connected to the locking-assembly support 272 by the pivot pin 296.

The locking member/actuator 280 includes a locking-member actuator 282 (here, a foot pedal), a first locking member 288 fixedly connected to the locking-member actuator 282 via a first arm 284, and a second locking member 290 fixedly connected to the locking-member actuator 282 via a second arm 286. Semicircular cutouts (shown but not labeled) shaped to partially receive the first and second locking pins 130 and 132 are defined in the first and second locking members 288 and 290. The free ends of the first and second locking members 288 and 290 include ramped surfaces (shown but not labeled) to facilitate self-locking of the coil carriage 200 (described below).

The locking member/actuator 280 is pivotable about the pivot pin 296 between: (1) a locking position (best shown in FIG. 6) at which the locking members 288 and 290 are in respective locking positions and (when the coil carriage 200 is in the strap-dispensing position) releasably engage the locking pins 130 and 132 and prevent the coil carriage 200 from moving to the extended position; and (2) a release position (best shown in FIG. 7) at which the locking members 288 and 290 are in respective release positions and (when the coil carriage 200 is in the strap-dispensing position) are disengaged from the locking pins 130 and 132 to enable the coil carriage 200 to move to the extended position. The first biasing element 276 and the second biasing element, which are torsion springs in this example embodiment but may be any other suitable biasing elements (such as compression springs or extension springs), bias the locking member/actuator 280 to the locking position. The locking-member actuator 282 is sized, shaped, positioned, oriented, and otherwise configured to be actuated (here, stepped on) by an operator to move the locking members 288 and 290 from their locking positions to their release positions (here, by pivoting the locking member/actuator 280 from its locking position to its release position).

As shown in FIG. 6, when the coil carriage 200 is in the strap-dispensing position and the locking members 288 and 290 are in their locking positions, the first and second locking pins 130 and 132 are received in the cutouts defined in the first and second locking members 288 and 290, respectively. When the locking-member actuator 282 is actuated (here, stepped on) by an operator, the locking members 288 and 290 move to their release positions and engage the first and second locking pins 130 and 132 such that they are removed from the cutouts. At this point the coil carriage 200 can be moved from the strap-dispensing position to the extended position shown in FIG. 5. As noted above, the coil-carriage locking assembly 270 is configured to self-lock when the coil carriage 200 is moved back to the strap-dispensing position. Specifically, as the coil carriage 200 is moved back to the strap-dispensing position, the locking member/actuator 280 is in its locking position (biased by the first and second biasing elements). Just before the coil carriage 200 reaches the strap-dispensing position, the ramped surfaces on the free ends of the first and second locking members 288 and 290 engage the first and second locking pins 130 and 132, respectively. Continued movement of the coil carriage 200 toward the strap-dispensing position causes the locking member/actuator 280 to slightly pivot toward the release position. The cutouts defined in the first and second locking members 288 and 290 reach the first and second locking pins 130 and 132 as the coil carriage 200 reaches the strap-dispensing position. When this occurs, the locking member/actuator 280 (and therefore the locking members 288 and 290) pivot back to the locking position such that the locking pins 130 and 132 are received in the respective cutouts to lock the coil carriage 200 in the strap-dispensing position. Thus, the coil-carriage locking assembly 270 is self-locking when the coil carriage 200 is moved from the extended position to the strap-dispensing position.

When the strap dispenser 102 is ready to or is dispensing strap from a strap coil mounted on the coil carriage 200, the coil carriage 200 is locked to the dispenser frame 110 via the coil-carriage locking assembly 270 in the strap-dispensing position. When the strap coil mounted on the coil carriage 200 is empty (or otherwise needs to be replaced or serviced), the coil carriage 200 is unlocked from the dispenser frame 110 via actuation of the pedal 282 of the coil-carriage locking assembly 270 and moved to the extended position. In the extended position, the strap coil can be accessed for service and/or removed from the coil carriage 200 and replaced with another strap coil. This movement of the coil carriage 200 relative to the dispenser frame 110 partly enables the compact construction and small footprint of the strap dispenser 102 (as well as strap dispensers 102*a*, 102*b*, 102*c*, 102*d*, and 102*e*) while providing complete, quick, and easy access to the strap coil, as further described below.

In the embodiment described above, the locking member and the locking-member actuator are integrally formed in a single component (the locking member/actuator). In other embodiments, the locking member and the locking-member actuator are separate components, and the locking-member actuator is operably connected to the locking member to move the locking member from its locked position to its unlocked position. The embodiment described above includes two locking members, though in other embodiments any suitable quantity of one or more locking members may be employed. The embodiment described above includes a locking member that pivots between its locked position to its unlocked position, though in other embodiments the locking member may move in any suitable manner between its locked and unlocked positions (such as linearly). The embodiment described above includes a locking-member actuator in the form of a pivotable foot pedal, though any suitable actuator may be employed, such as a hand-actuated button, a controller-actuated device, a linear actuator, or a motor.

Figure 14:
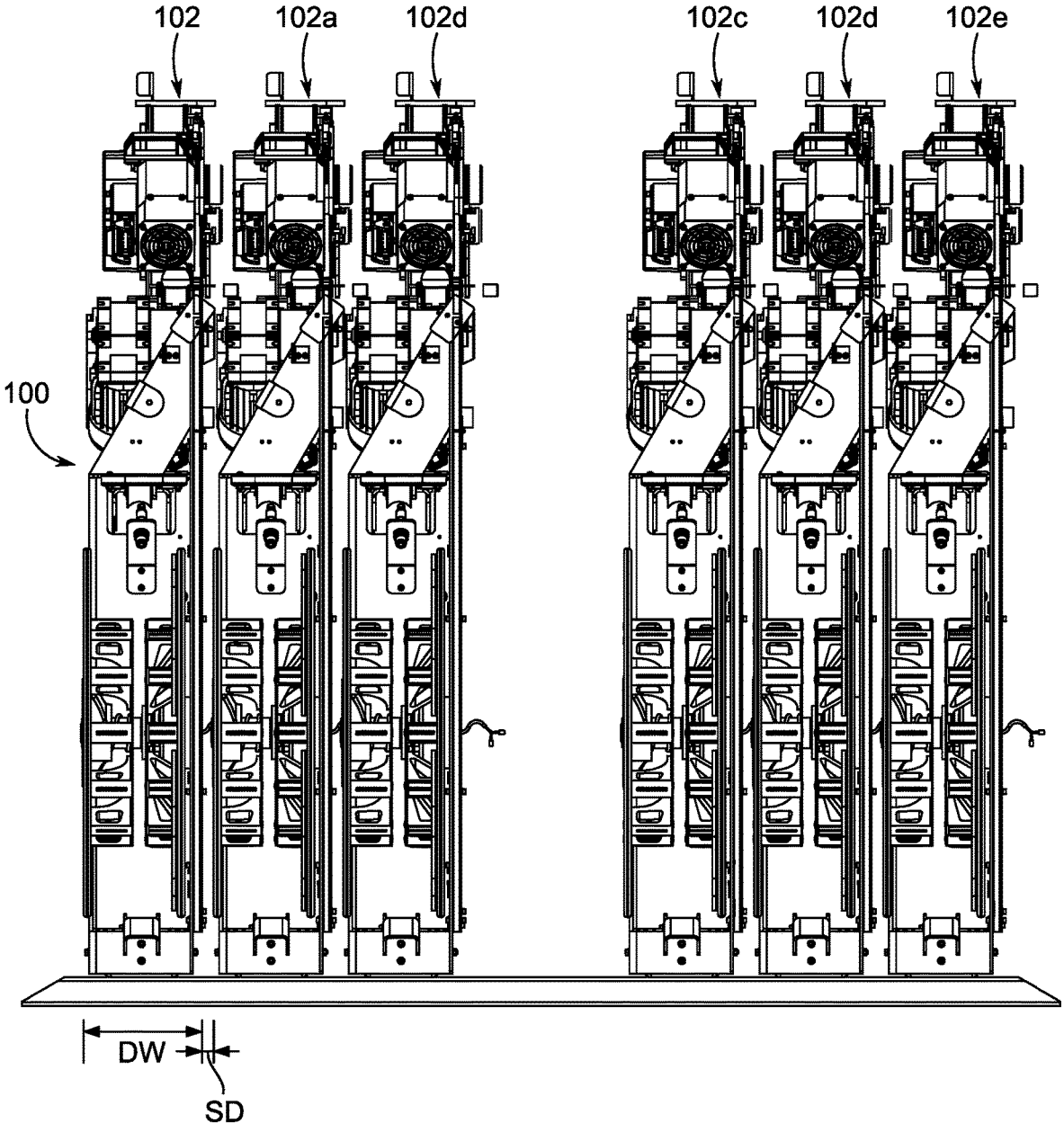
FIG. 14 is a front view of the plurality of compact strap dispensers of the strapping machine of FIG. 2 showing the respective widths of the strap dispensers and the spaces between the strap dispensers.

The ability of the coil carriage 200 to extend relative to the dispenser frame 110 to enable an operator to change the strap coil enables the dispensers to be arranged close to one another, which provides several benefits with respect to the configuration of the strapping machine 10 as a whole. FIG. 13 is a top view of the strapping machine 10 and shows how the compact strap dispensers 102, 102*a*, 102*b*, 102*c*, 102*d*, and 102*e* of the strap supply 100 can be positioned close to one another to minimize the width of the strapping machine 10, where the top-to-bottom direction represents width from the perspective shown in FIG. 13. Specifically, the strap dispensers 102, 102*a*, 102*b*, 102*c*, 102*d*, and 102*e* are positionable adjacent to one another such that their collective width TSDW is less than or substantially equal to (such as within 1% of, 5% of, or 10% of, depending on the embodiment) the width FW of the machine frame 12. In this example, FW is 1640 millimeters and TSDW is 1658 millimeters. FIG. 14 is a front view of the strap dispensers 102, 102*a*, 102*b*, 102*c*, 102*d*, and 102*e* and shows how close the strap dispensers can be positioned relative to one another. Specifically, the strap dispensers 102, 102*a*, 102*b*, 102*c*, 102*d*, and 102*e* are positionable such that the width SD of the space between adjacent strap dispensers is less than the width DW of each strap dispenser. In this example SD is 15.5 millimeters and DW is 248.8 millimeters. In this configuration, an operator cannot remove the strap coil of one of the inner strap dispensers, such as from strap dispenser 102*a*, without moving its coil carriage to the extended position.

The ability of the coil carriages of the strap dispensers to extend for coil changes enables the width SD separating adjacent strap dispensers to be just a few centimeters (or even millimeters), which provides just enough space to enable the coil carriages of adjacent strap dispensers to extend freely relative to one another. The strapping machine including the compact strap dispensers of the present disclosure thus improves upon known strapping machines by providing a more compact footprint, thereby taking up less floor space.

As also shown in FIG. 13, a the strap dispensers are narrow enough to position them so the space between a first set of the strap dispensers 102, 102*a*, and 102*b* and a second set of the strap dispensers 102*c*, 102*d*, and 102*e* is wider than the spaces between the dispensers within a particular set. This larger space is provided so each strap dispenser 102, 102*a*, and 102*b*, 102*c*, 102*d*, and 102*e* can be aligned or substantially aligned with its respective sealing module 50*c* (not shown in FIG. 13) on the platen 30 to avoid extensive bends in the strap guides connecting the tension modules 50*b* on the strap dispensers to the sealing modules, thereby decreasing the likelihood of jams occurring. This is also shown in FIG. 2. In other words, each strap guide generally extends within a plane, and the planes of all of the strap guides are substantially parallel to one another and substantially perpendicular to the width direction. Additionally, in this configuration, the strap guides all have the same or substantially the same length. This additional space and this alignment feature for the strap dispensers is (again) enabled by the above described configuration of the strap dispensers and, particularly, the ability of the coil carriage to extend relative to the dispenser frame to enable an operator to swap the strap coil without interference from or interfering with adjacent strap dispensers even though the dispensers are close to one another.

This example the strap dispenser 102 also includes a strap-coil holder 300 that rotatably supports a strap coil and includes a quick-release retainer 390 that retains the strap coil in place while being quickly and easily removable for coil changes (such as when the coil carriage 200 is in the extended position). The strap-coil holder 300 includes an axle assembly 310, a rear coil supporter 320, a front coil supporter 380, and the retainer 390.

The axle assembly 310 (best shown in FIG. 9) includes a base 311 and a cylindrical axle 314 extending from the base 311. The base 311 is fixedly connected to and extends transversely inwardly from the support wall 250. The axle 314 is fixedly connected to and extends transversely inwardly from the base 311. The axle assembly 310 rotatably supports the rear coil supporter 320, the front coil supporter 380, the retainer 390, and a strap coil mounted on and between the rear and front coil supporters.

The rear coil supporter 320 includes an annular outer plate 322 and an inner coil-support ring 330 fixedly connected to one another via a plurality of spaced-apart inwardly extending coil-engaging members 323 (only one of which is labeled) configured to engage the inner circumference of the strap coil to enable the strap-coil holder 300 to hold the strap coil. The coil-support ring 330 is sized slightly smaller than the inner circumference of the strap coil.

Figure 10:
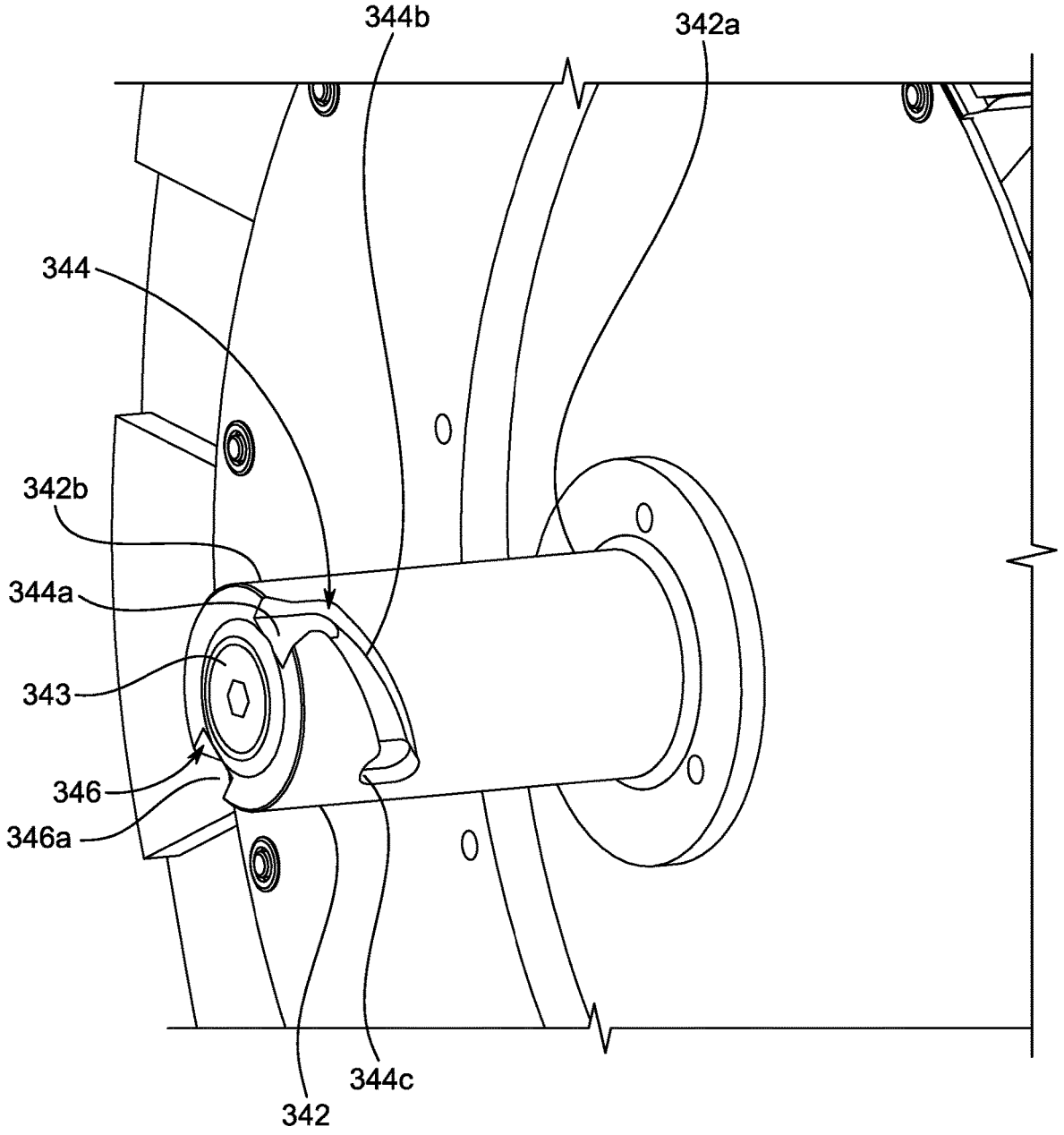
FIG. 10 is a perspective view of part of the strap-coil holder of FIG. 8 showing the locking shaft.
Figure 11:
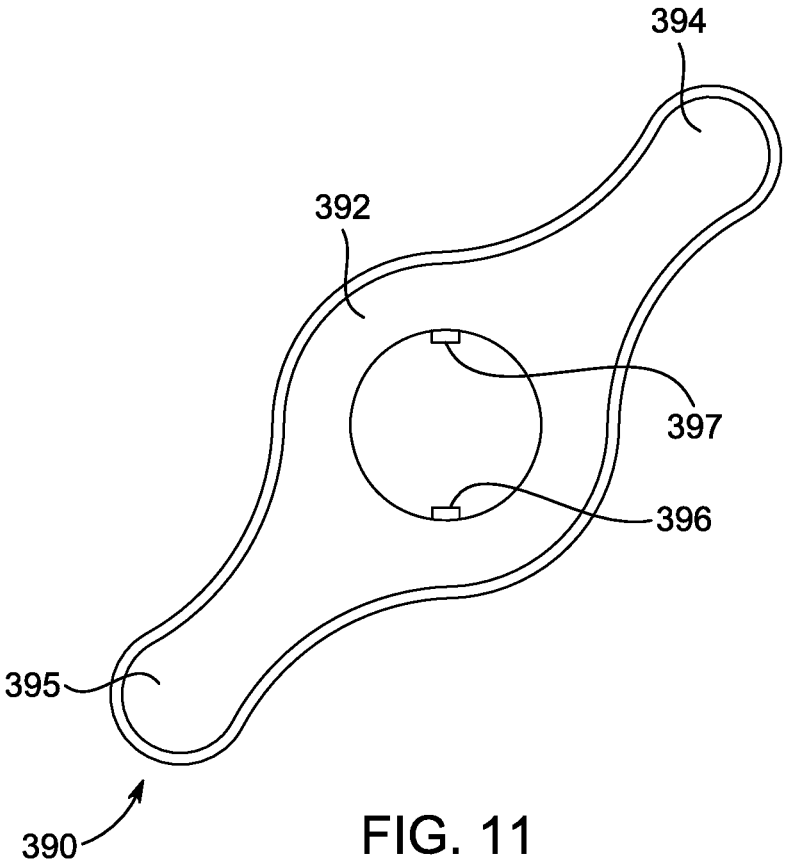
FIG. 11 is an elevational view of the retainer of the strap-coil holder of FIG. 8.

A tubular locking shaft 342 is fixedly connected to (such as via a flange and fasteners) and extends transversely inwardly from the coil-support ring 330. The locking shaft includes a first end section 342*a* adjacent to the coil-support ring 330 and a second end section 342*b* opposite the coil-support ring 330. The second end section 342*b* is a free end and includes a plurality of surfaces extending radially inward from the outer cylindrical surface of the locking shaft 342 that define a first locking-pin-receiving groove 344 on a first side of the locking shaft 342 and a second locking-pin-receiving groove 346 (partially shown) on an opposite second side of the locking shaft 342. These grooves are generally helically shaped in this example embodiment, though they may take any other suitable shape in other embodiments. In this example embodiment, the first and second locking-pin-receiving grooves 344 and 346 are identical (though they need not be in other embodiments). As best shown in FIG. 10, the first locking-pin-receiving groove 344 includes a locking-pin entry/exit area 344*a*, a locking-pin travel area 344*b* (referred to as the "rotation area" herein due to the helical shape of the groove), and a locking-pin locking area 344*c*. Likewise, the second locking-pin-receiving groove 346 includes a locking-pin entry/exit area 346*a*, a locking-pin travel area (not shown) (referred to as the "rotation area" herein due to the helical shape of the groove), and a locking-pin locking area (not shown).

The front coil supporter 380 includes an annular outer plate 382 and an inner coil-support ring 384 fixedly connected to one another via a plurality of spaced-apart inwardly extending coil-engaging members 386 (only one of which is labeled) configured to engage the inner circumference of the strap coil to enable the strap-coil holder 300 to hold the strap coil. The inner coil support ring 384 defines a central opening 385 through which the locking shaft 342 extends when the front coil supporter is mounted on the rear coil supporter 320.

The retainer 390 includes a tubular hub 392, a first handle 394 connected to and extending radially outwardly from the hub 392, a second handle 395 connected to and extending radially outwardly from the hub 392, a first locking pin 396 connected to and extending radially inwardly from the hub 392, a second locking pin 397 connected to and extending radially inwardly from the hub 392, and a retainer biasing element 398 (here, a compression spring) connected to and extending transversely from the hub 392.

Figure 12:
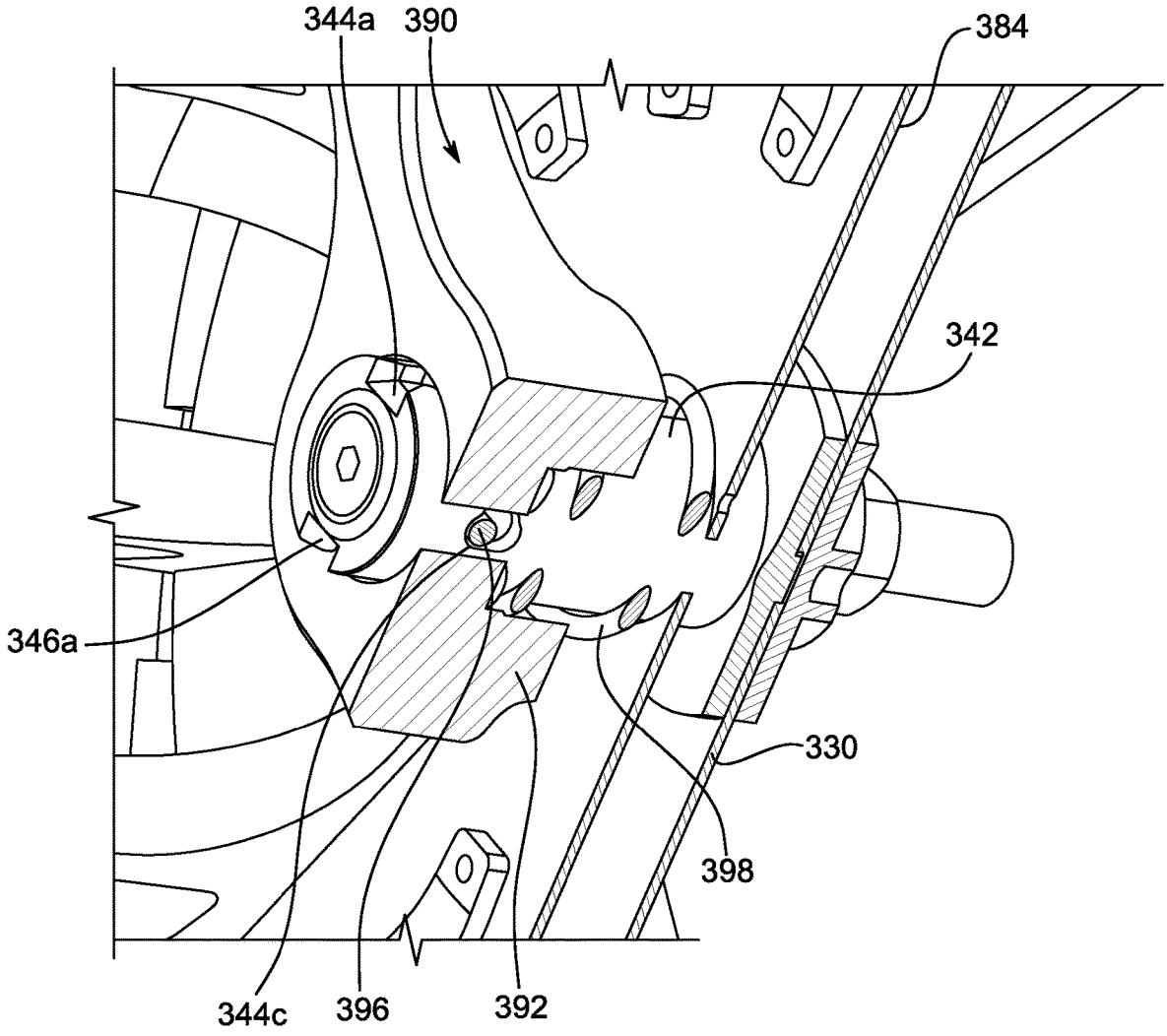
FIG. 12 is a cross-sectional perspective view of the retainer engaging the locking shaft of the strap-coil holder of FIG. 8.

The retainer 390 lockingly engages the locking shaft 342 to retain the front coil supporter 380 on the locking shaft 342 and the strap coil on the strap-coil holder 300. Specifically, when the retainer 390 lockingly engages the locking shaft 342, the retainer 390 is in a locked position at which the first locking pin 396 of the retainer 390 is received in the locking-pin locking area 344*c* of the first locking-pin-receiving groove 344 of the locking shaft 342, as shown in FIG. 12, and the second locking pin 397 of the retainer 390 is received in the locking-pin locking area of the second locking-pin-receiving groove 346 of the locking shaft 342. The retainer biasing element 398 biases the retainer 390 outward (away from the front coil supporter 380) and therefore biases the locking pins into the locking-pin locking areas and the retainer 390 to the locked position. The locking pins and the locking-pin locking areas are sized, shaped, positioned, oriented, and otherwise configured such that the locking pins prevent the retainer 390 from rotating relative to the locking shaft 342 when the locking pins are received in the locking-pin locking areas. Since the retainer 390 cannot rotate relative to the locking shaft 342 when in the locked position, the retainer 390 (and therefore the front coil supporter 380 and the strap coil) cannot be removed from the locking shaft 342 unless moved from the locked position.

When a strap coil mounted on the coil carriage 200 is empty or otherwise needs to be replaced, the retainer 390 is first pushed inward (toward the front coil supporter 380) against the biasing force of the retainer biasing element 398 such that: (1) the first locking pin 396 of the retainer 390 moves inwardly to exit the locking-pin locking area 344*c* of the first locking-pin-receiving groove 344 and enter the locking-pin rotation area 344*b* of the first locking-pin-receiving groove 344; and (2) the second locking pin 397 of the retainer 390 moves inwardly to exit the locking-pin locking area of the second locking-pin-receiving groove 346 and enter the locking-pin rotation area of the second locking-pin-receiving groove 346. The retainer 390 is then rotated counterclockwise and pulled outward (with the assistance of the retainer biasing element 398) such that: (1) the first locking pin 396 of the retainer 390 traverses the locking-pin rotation area 344*b* of the first locking-pin-receiving groove 344 and enters the locking-pin entry/exit area 344*a* of the first locking-pin-receiving groove 344; and (2) the second locking pin 397 of the retainer 390 traverses the locking-pin rotation area of the second locking-pin-receiving groove 346 and enters the locking-pin entry/exit area 346*a* of the second locking-pin-receiving groove 346.

The retainer 390 is then pulled outwardly (with assistance of the retainer biasing member 398) such that: (1) the first locking pin 396 of the retainer 390 exits the locking-pin entry/exit area 344*a* of the first locking-pin-receiving groove 344; and (2) the second locking pin 397 of the retainer 390 exits the locking-pin entry/exit area 346*a* of the second locking-pin-receiving groove 346. At this point, the retainer 390 is removed from the locking shaft 342. Once the retainer 390 is removed, the front coil supporter 380 can be removed from (slid off of in this example embodiment) the locking shaft 342 to provide access to the strap coil. The strap coil is then removed from the rear coil supporter 320, and a new strap coil is mounted on the rear coil supporter 320. The front coil supporter 380 is then put back on the locking shaft 342.

The retainer 390 is then again lockingly engaged to the locking shaft 342 to retain the front coil supporter 380 on the locking shaft 342 and the new strap coil on the strap-coil holder 300. Specifically, the retainer 390 is positioned on the locking shaft 342 such that: (1) the first locking pin 396 of the retainer 390 enters the locking-pin entry/exit area 344*a* of the first locking-pin-receiving groove 344; and (2) the second locking pin 397 of the retainer 390 enters the locking-pin entry/exit area 346*a* of the second locking-pin-receiving groove 346. The retainer 390 is then rotated clockwise such that: (1) the first locking pin 396 of the retainer 390 enters and traverses the locking-pin rotation area 344*b* of the first locking-pin-receiving groove 344; and (2) the second locking pin 397 of the retainer 390 enters and traverses the locking-pin rotation area of the second locking-pin-receiving groove 346. The retainer 390 is then released and the retainer biasing element 398 forces the retainer 390 outwardly such that: (1) the first locking pin 396 of the retainer 390 moves outwardly to exit the locking-pin rotation area 344*b* of the first locking-pin-receiving groove 344 and enter the locking-pin locking area 344*c* of the first locking-pin-receiving groove 344; and (2) the second locking pin 397 of the retainer 390 moves outwardly to exit the locking-pin-rotation area of the second locking-pin receiving groove 346 and enter the locking-pin locking area of the second locking-pin receiving groove 346. The retainer biasing element 398 biases the retainer 390 outwardly to maintain the retainer 390 in this position.

This configuration of the strap-coil holder, and particularly the locking shaft and the retainer that can lockingly engage the locking shaft, provides a quick-release functionality that makes changing strap coils more efficient as compared to certain prior art strap dispensers. For instance, an operator need only push and partially rotate the retainer to remove it from the locking shaft to get access to the front coil supporter and the strap coil. Certain prior art strap dispensers include threaded caps that screw onto and off of a shaft to retain the front coil supporter in place. These threaded caps are not locked into place when screwed onto the shaft—meaning that they can accidentally unthread—and require several rotations to screw them onto and off of the shaft. This is tedious and takes significantly more time than the solution of the present disclosure.

Although the illustrated strap dispenser 102 includes the movable coil carriage 200 and the strap-coil holder 300 with the retainer 390, in other embodiments the strap dispenser 102 may include only one of the movable coil carriage 200 and the strap-coil holder 300 with the retainer 390. For instance, an alternative strap dispenser may include the illustrated and described movable coil carriage and a different strap-coil holder, and another alternative strap dispenser may include a different coil carriage (such as an immovable coil carriage) with the illustrated and described strap-coil holder.

The invention claimed is:

1. A strap dispenser for a strapping machine, the strap dispenser comprising:

a dispenser frame;

a coil carriage mounted to the dispenser frame and moveable relative to the dispenser frame between a strap-dispensing position and an extended position, the coil carriage comprising a rotatable strap-coil holder;

a coil-carriage locking assembly configured to lock the coil carriage in the strap-dispensing position to prevent the coil carriage from moving to the extended position and comprising a locking member movable between a locking position and a release position; and an engageable element positioned to be releasably engaged by the coil-carriage locking assembly to lock the coil carriage in the strap-dispensing position, wherein when the coil carriage is in the strap-dispensing position and the locking member is in the locking position, the locking member releasably engages the engageable element to lock the coil carriage in the strap-dispensing position.

2. The strap dispenser of claim 1, wherein the one of the engageable element and the coil-carriage locking assembly is mounted to the dispenser frame and the other of the engageable element and the coil-carriage locking assembly is mounted to the coil carriage.

3. The strap dispenser of claim 1, wherein the coil-carriage locking assembly further comprises a locking-member actuator operably connected to the locking member such that actuation of the locking-member actuator moves the locking member from the locking position to the release position.

4. The strap dispenser of claim 3, wherein the coil carriage is slidably mounted to the dispenser frame and slidable relative to the dispenser frame between the strap-dispensing and extended positions.

5. The strap dispenser of claim 3, wherein the coil-carriage locking assembly further comprises a biasing element biasing the locking member to the locking position.

6. The strap dispenser of claim 3, wherein the locking member is pivotable between the locking and release positions.

7. The strap dispenser of claim 6, wherein the locking member and the locking-member actuator are integrally formed with one another as a locking member/actuator.

8. The strap dispenser of claim 7, wherein the locking member/actuator is pivotable to move the locking member from the locking position to the release position.

9. The strap dispenser of claim 8, wherein the locking-member actuator comprises a foot pedal.

10. The strap dispenser of claim 5, wherein the engageable element comprises a locking pin.

11. The strap dispenser of claim 10, wherein the locking member comprises a ramped surface and defines a cutout, wherein the cutout is sized and shaped to receive part of the locking pin when the locking member is in the locking position and the coil carriage is in the strap-dispensing position to lock the coil carriage in the strap-dispensing position, wherein the ramped surface is oriented such that, as the coil carriage moves from the extended position toward the strap-dispensing position, the ramped surface engages the locking pin and forces the locking member to pivot toward the release position.

12. The strap dispenser of claim 1, wherein the strap-coil holder comprises an axle assembly, a rear coil supporter rotatably mounted to the axle assembly and comprising a locking shaft, a front coil supporter removably mounted to the locking shaft, a retainer removably mounted to the locking shaft, and a biasing element biasing the retainer to a locked position to prevent removal of the retainer from the locking shaft.

13. A strap dispenser for a strapping machine, the strap dispenser comprising:

a dispenser frame;

a coil carriage slidably mounted to the dispenser frame and moveable relative to the dispenser frame between a strap-dispensing position and an extended position, the coil carriage comprising a rotatable strap-coil holder;

a coil-carriage locking assembly configured to lock the coil carriage in the strap-dispensing position, the coil-carriage locking assembly comprising:

a locking member movable between a locking position and a release position;

a locking-member actuator operably connected to the locking member such that actuation of the locking-member actuator moves the locking member from the locking position to the release position; and a biasing element biasing the locking member to the locking position; and an engageable element positioned to be releasably engaged by the coil-carriage locking assembly to lock the coil carriage in the strap-dispensing position, wherein when the coil carriage is in the strap-dispensing position and the locking member is in the locking position, the locking member releasably engages the engageable element to lock the coil carriage in the strap-dispensing position.

14. A strap dispenser for a strapping machine, the strap dispenser comprising:

a dispenser frame;

a coil carriage slidably mounted to the dispenser frame and moveable relative to the dispenser frame between a strap-dispensing position and an extended position, the coil carriage comprising a rotatable strap-coil holder;

a coil-carriage locking assembly configured to lock the coil carriage in the strap-dispensing position, the coil-carriage locking assembly comprising:

a locking member pivotable between a locking position and a release position; and a locking-member actuator operably connected to the locking member such that actuation of the locking-member actuator moves the locking member from the locking position to the release position; and an engageable element positioned to be releasably engaged by the coil-carriage locking assembly to lock the coil carriage in the strap-dispensing position, wherein when the coil carriage is in the strap-dispensing position and the locking member is in the locking position, the locking member releasably engages the engageable element to lock the coil carriage in the strap-dispensing position.

15. A strap dispenser for a strapping machine, the strap dispenser comprising:

a dispenser frame; and a coil carriage mounted to the dispenser frame and moveable relative to the dispenser frame between a strap-dispensing position and an extended position, the coil carriage comprising a rotatable strap-coil holder comprising:

an axle assembly;

a rear coil supporter rotatably mounted to the axle assembly and comprising a locking shaft;

a front coil supporter removably mounted to the locking shaft;

a retainer removably mounted to the locking shaft; and a biasing element biasing the retainer to a locked position to prevent removal of the retainer from the locking shaft.

* * * * *